US011220888B2

(12) United States Patent
Ocegueda-Hernandez et al.

(10) Patent No.: US 11,220,888 B2
(45) Date of Patent: Jan. 11, 2022

(54) METHOD FOR OPTIMIZING PERFORMANCE OF AN AUTOMATED CONTROL SYSTEM FOR DRILLING

(71) Applicant: National Oilwell Varco, L.P., Houston, TX (US)

(72) Inventors: Francisco Ocegueda-Hernandez, Houston, TX (US); Ryan J. Hanford, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 465 days.

(21) Appl. No.: 16/166,015

(22) Filed: Oct. 19, 2018

(65) Prior Publication Data

US 2019/0120023 A1 Apr. 25, 2019

Related U.S. Application Data

(60) Provisional application No. 62/575,145, filed on Oct. 20, 2017.

(51) Int. Cl.

| | |
|---|---|
| ***E21B 44/00*** | (2006.01) |
| ***E21B 44/04*** | (2006.01) |
| ***E21B 41/00*** | (2006.01) |

(52) U.S. Cl.

CPC ..... *E21B 41/0092* (2013.01); *E21B 44/00* (2013.01); *E21B 44/04* (2013.01)

(58) Field of Classification Search

CPC ..... E21B 41/0092; E21B 44/04; E21B 44/00

See application file for complete search history.

(56) References Cited

U.S. PATENT DOCUMENTS

| | | | |
|---|---|---|---|
| 5,448,911 | A | 9/1995 | Mason |
| 8,256,534 | B2 | 9/2012 | Byreddy |

(Continued)

FOREIGN PATENT DOCUMENTS

| | | | |
|---|---|---|---|
| GB | 2518282 | B | 3/2015 |
| WO | 2016019077 | A1 | 2/2016 |

(Continued)

OTHER PUBLICATIONS

International Search Report and Written Opinion received in PCT Application No. PCT/US2018/056791, dated Jan. 15, 2019.

(Continued)

*Primary Examiner* — Natalie Huls
*Assistant Examiner* — Michael J Singletary
(74) *Attorney, Agent, or Firm* — Blank Rome LLP

(57) ABSTRACT

A method for optimizing performance of a drilling process by an automated control system for drilling, comprising obtaining a measure of performance for each drilling activity of a set of drilling activities for the drilling process; calculating an activity performance index for each drilling activity by obtaining reference data for each drilling activity, comparing the measures of performance for each drilling activity to the reference data for the particular drilling activity, calculating the activity performance index for each drilling activity based on the comparison; generating a drilling process performance index based on the activity performance indexes; comparing, for each of the drilling activities, a configuration of one or more drilling parameters to a reference configuration of drilling parameters associated with the reference data for the particular drilling activity; and adjusting the configuration of one or more drilling parameters associated with one or more drilling activities based on the comparison.

20 Claims, 11 Drawing Sheets

(56) References Cited

U.S. PATENT DOCUMENTS

| | | | | |
|---|---|---|---|---|
| 2012/0118637 | A1 | 5/2012 | Wang | |
| 2012/0123756 | A1* | 5/2012 | Wang | E21B 44/00 703/2 |
| 2013/0032407 | A1* | 2/2013 | Edbury | E21B 37/00 175/61 |
| 2015/0053482 | A1* | 2/2015 | Boone | E21B 44/00 175/24 |
| 2015/0112949 | A1* | 4/2015 | Marland | G06Q 10/0639 707/688 |
| 2016/0265336 | A1 | 9/2016 | Benson | |
| 2017/0152741 | A1 | 6/2017 | Park | |

FOREIGN PATENT DOCUMENTS

| | | | | |
|---|---|---|---|---|
| WO | 2016162659 | A1 | 10/2016 | |
| WO | 2016176428 | A1 | 11/2016 | |
| WO | WO-2017116474 | A1 * | 7/2017 | E21B 7/04 |
| WO | 2017171557 | A1 | 10/2017 | |

OTHER PUBLICATIONS

International Search Report and Written Report received in PCT Application No. PCT/US2019/028616, dated Aug. 1, 2019.

International Search Report and Written Report received in PCT Application No. PCT/US2019/028701, dated Aug. 5, 2019.

Extended European Search Report dated Jun. 17, 2021, issued in counterpart European Application EP 18868403.9.

Ambrus, A. et al. "A Novel Probabilistic Rig Based Drilling Optimization Index to Improve Drilling Performance." Society of Petroleum Engineers, SPE-186166-MS; Aberdeen, Sep. 5-8, 2017, pp. 1-14. http://onepetro.org/SPEOE/proceedings-pdf/17OE/1-17OE/D011S001R002/1312825/spe-186166-ms.pdf/1; DOI:10.2188/186166-MS.

* cited by examiner

MEASURE OF PERFORMANCE DATA
710

| Conn.Num. | Depth | TW | FR | RR | LS | S2B |
|---|---|---|---|---|---|---|
| 1 | 1523 | 53 | 248 | 36 | 65 | 402 |
| 2 | 1618 | 38 | 90 | 24 | 50 | 202 |
| 3 | 1713 | 29 | 127 | 31 | 64 | 251 |
| 4 | 1808 | 26 | 36 | 47 | 62 | 171 |
| 5 | 1903 | 43 | 85 | 37 | 78 | 243 |
| 6 | 1998 | 43 | 85 | 36 | 46 | 210 |
| 7 | 2093 | 14 | 27 | 28 | 38 | 107 |
| 8 | 2188 | 21 | 36 | 51 | 39 | 147 |
| 9 | 2283 | 21 | 31 | 45 | 7 | 104 |
| 10 | 2378 | 36 | 213 | 25 | 48 | 322 |
| 11 | 2473 | 34 | 379 | 61 | 39 | 513 |
| 12 | 2568 | 33 | 59 | 28 | 47 | 167 |
| 13 | 2663 | 20 | 21 | 19 | 34 | 94 |
| 14 | 2758 | 17 | 17 | 10 | 47 | 91 |
| 15 | 2853 | 21 | 72 | 24 | 52 | 169 |
| 16 | 2948 | 258 | 280 | 15 | 58 | 611 |
| 17 | 3043 | 19 | 30 | 14 | 40 | 103 |
| 18 | 3138 | 13 | 21 | 22 | 33 | 89 |
| 19 | 3233 | 21 | 34 | 24 | 82 | 161 |
| 20 | 3328 | 15 | 26 | 1 | 30 | 72 |

HISTOGRAM
720

| Conn.Num. | Depth | TW | FR | RR | LS | S2B |
|---|---|---|---|---|---|---|
| 18 | 3138 | 13 | 21 | 22 | 33 | 89 |
| 14 | 2758 | 17 | 17 | 10 | 47 | 91 |
| 13 | 2663 | 20 | 21 | 19 | 34 | 94 |
| 17 | 3043 | 19 | 30 | 14 | 40 | 103 |
| 9 | 2283 | 21 | 31 | 45 | 7 | 104 |
| 7 | 2093 | 14 | 27 | 28 | 38 | 107 |
| 8 | 2188 | 21 | 36 | 51 | 39 | 147 |
| 19 | 3233 | 21 | 34 | 24 | 82 | 161 |
| 12 | 2568 | 33 | 59 | 28 | 47 | 167 |
| 15 | 2853 | 21 | 72 | 24 | 52 | 169 |

BEST PERFORMANCES
730

REFERENCE PERFORMANCE INDEX
740

| | | TW | FR | RR | LS | S2B |
|---|---|---|---|---|---|---|
| Reference Baseline | Average | 20 | 34.8 | 26.5 | 41.9 | 123.2 |

*FIG. 7B*

| Conn. Num. | Depth | TW | FR | RR | LS |
|---|---|---|---|---|---|
| 21 | 3328 | 30 | 40 | 18 | 60 |

MEASURE OF PERFORMANCE DATA FOR CONNECTION 21
750

| Conn. Num. | Depth | TW PI | FR PI | RR PI | LS PI | S2B PI |
|---|---|---|---|---|---|---|
| 21 | 3328 | 0 | 0 | 1 | 0 | 1 |

PERFORMANCE INDEXES FOR CONNECTION 21
755

| Conn. Num. | Depth | TW | FR | RR | LS |
|---|---|---|---|---|---|
| 22 | 3423 | 16 | 30 | 18 | 35 |

MEASURE OF PERFORMANCE DATA FOR CONNECTION 22
760

| Conn. Num. | Depth | TW PI | FR PI | RR PI | LS PI | S2B PI |
|---|---|---|---|---|---|---|
| 22 | 3423 | 1 | 1 | 1 | 1 | 4 |

PERFORMANCE INDEXES FOR CONNECTION 22
765

*FIG. 7C*

METHOD FOR OPTIMIZING PERFORMANCE OF AN AUTOMATED CONTROL SYSTEM FOR DRILLING

Embodiments described herein generally relate to automated drilling, and more specifically to optimizing performance of an automated control system for drilling.

BACKGROUND ART

Oilfield operations may be performed to locate and gather valuable downhole fluids. Oil rigs are positioned at wellsites, and downhole tools, such as drilling tools and other components, are deployed into the ground to reach subsurface reservoirs. Traditionally, human operators press dozens of buttons in order to operate rig equipment to complete the drilling process. In addition, although a human operator may be relying on feedback provided by the downhole tools, drilling operations controlled by human operation may lack consistency, or may be subject to human error. Thus, an automated control system for drilling is preferred. However, an automated control system may be slow compared to manual operation of the drilling rig. Further, while some drilling applications allow for a software-based management of drilling operations, they often require the application developer to tailor the application to the specifications of a particular rig, such as specific tools, and language needed to drive those tools. A method of optimizing an automated control system is needed.

BRIEF DESCRIPTION OF DRAWINGS

FIGS. 7A-C illustrate generation of an example reference performance index using example reference data.

DESCRIPTION OF EMBODIMENTS

Figure 1:
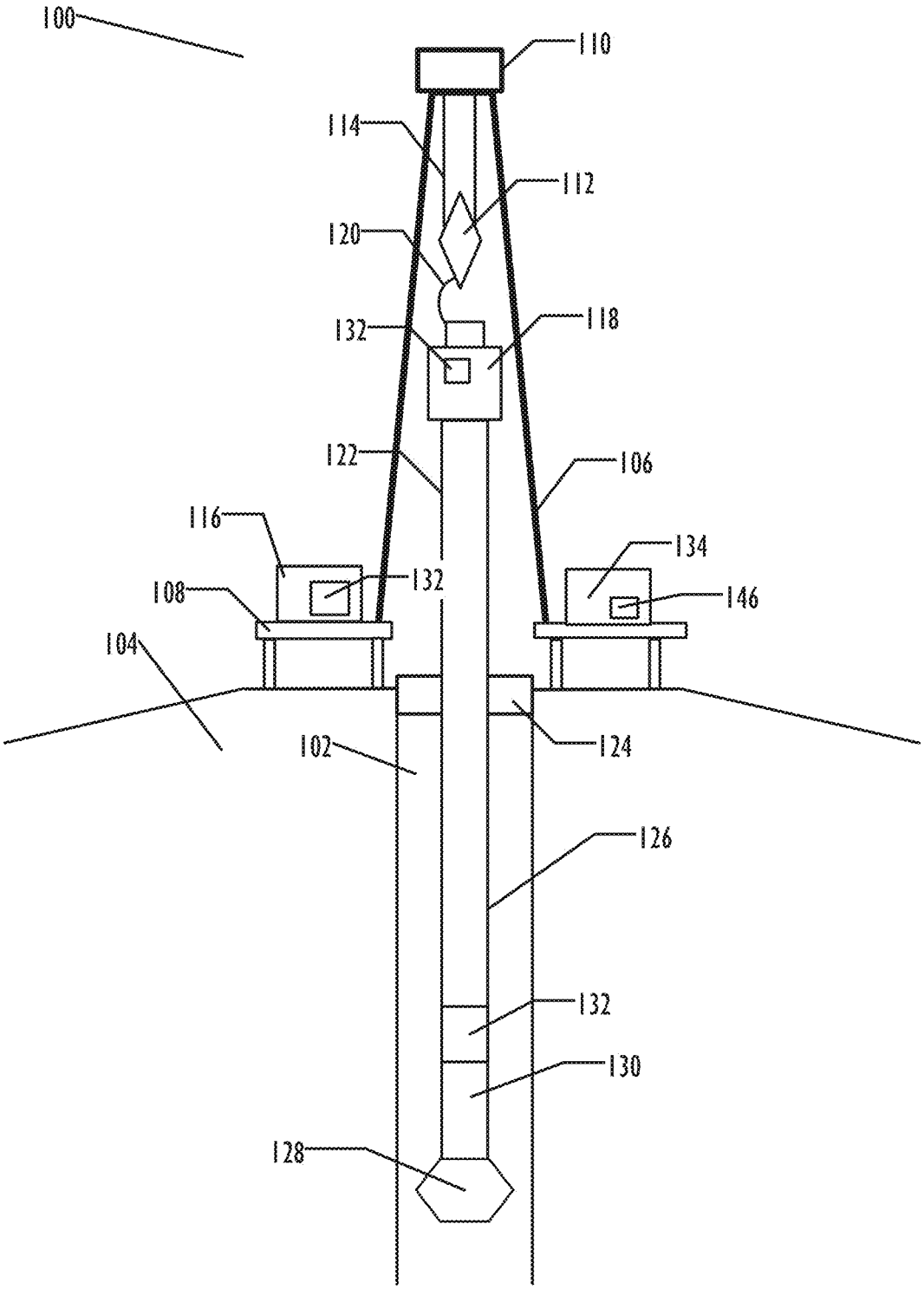
FIG. 1 is a diagram illustrating an apparatus for performing automated drilling operations utilizing a drilling rig software system.

In the following description, for purposes of explanation, numerous specific details are set forth in order to provide a thorough understanding of the disclosed concepts. As part of this description, some of this disclosure's drawings represent structures and devices in block diagram form in order to avoid obscuring the novel aspects of the disclosed embodiments. In this context, it should be understood that references to numbered drawing elements without associated identifiers (e.g., 100) refer to all instances of the drawing element with identifiers (e.g., 100*a* and 100*b*).

Further, as part of this description, some of this disclosure's drawings may be provided in the form of a flow diagram. The boxes in any particular flow diagram may be presented in a particular order. However, it should be understood that the particular flow of any flow diagram is used only to exemplify one embodiment. In other embodiments, any of the various components depicted in the flow diagram may be deleted, or the components may be performed in a different order, or even concurrently. In addition, other embodiments may include additional steps not depicted as part of the flow diagram. The language used in this disclosure has been principally selected for readability and instructional purposes, and may not have been selected to delineate or circumscribe the disclosed subject matter. Reference in this disclosure to "one embodiment" or to "an embodiment" means that a particular feature, structure, or characteristic described in connection with the embodiment is included in at least one embodiment, and multiple references to "one embodiment" or to "an embodiment" should not be understood as necessarily all referring to the same embodiment or to different embodiments.

It should be appreciated that in the development of any actual implementation (as in any development project), numerous decisions must be made to achieve the developers' specific goals (e.g., compliance with system and business-related constraints), and that these goals will vary from one implementation to another. It will also be appreciated that such development efforts might be complex and time consuming, but would nevertheless be a routine undertaking for those of ordinary skill in the art of automated drilling having the benefit of this disclosure.

As used herein, the term "programmable device" refers to a single programmable device or a plurality of programmable devices working together to perform the function described as being performed on or by the programmable device.

As used herein, the term "medium" refers to a single physical medium or a plurality of media that together store what is described as being stored on the medium.

As used herein, the term "network device" refers to any programmable device that is capable of communicating with another programmable device across any type of network.

As used herein, the term "drilling rig" refers to a land or offshore rig apparatus utilized to drill a borehole.

As used herein, the term "drilling tool" refers to drilling components such as drilling devices or sensors utilized to perform drilling activities.

According to one or more embodiments, the performance of an automated control system for drilling may be optimized. In one or more embodiments, an optimization module may generate a measure of performance based on the automated control system's historical performance in a current well or a reference well, or that of an individual driller not using an automated control system. Performance may be measured, for example, in drilling time, cost, wear and tear on tools, risk, and the like. Accordingly, higher performance measurements may be associated with, for example, faster drilling time, lower cost, less wear and tear on tools, lower risk, and the like. The optimization module may then gauge the automated control system's current performance against the measure of performance and determine adjustments to configurations of drilling parameters where appropriate. As an example, the optimization module reviews performance of a particular drilling sub-process and the set of one or more drilling activities associated with the particular drilling sub-process. The optimization module may obtain a time to complete each activity of the set of one or more drilling activities. Then, the optimization module uses the obtained time to calculate an activity performance index by comparing the obtained time to complete the activity to a reference time to complete the activity. An activity performance index is a measure of the automated control system's performance of the activity as compared to reference performance of the activity. The activity performance indexes for the set of one or more drilling activities may be combined to create a drilling sub-process performance index and indicate a measure of performance for the drilling sub-process as a whole. Based on the measure of performance for the drilling sub-process, the optimization module may adjust the automated control system's configurations of drilling parameters for better performance based on the configurations used in the reference performance of the drilling sub-process.

In one embodiment of the invention, as illustrated in FIG. 1, an apparatus 100 for automated drilling of a borehole 102 in a subsurface formation 104 includes a derrick 106 on a rig floor 108. A crown block 110 is mounted at the top of the derrick 106, and a traveling block 112 hangs from the crown block 110 by means of a cable or drilling line 114. One end of the cable or drilling line 114 is connected to drawworks 116, which is a reeling device operable to adjust the length of the cable or drilling line 114 so that the traveling block 112 moves up and down the derrick 106. A top drive 118 is supported on a hook 120 attached to the bottom of the traveling block 112. The top drive 118 is coupled to the top of a drill string 122, which extends through a wellhead 124 into the borehole 102 below the rig floor 108. The top drive 118 is used to rotate the drill string 122 inside the borehole 102 as the borehole 102 is being drilled in the subsurface formation 104. A bottomhole assembly 126 is provided at the bottom of the drill string 122. The bottomhole assembly 126 includes a bit 128 and a downhole motor 130 and may include other components not specifically identified but known in the art, e.g., a sensor package.

Although not shown, the automated drilling apparatus 100 includes a mud tank containing drilling fluid or "mud," a mud pump for transferring the drilling fluid to a mud hose, and a mud treatment system for cleaning the drilling fluid when it is laden with subsurface formation cuttings. The mud hose, in use, is fluidly connected to the drill string such that the drilling fluid can be pumped from the mud tank into the drill string. The drilling fluid is returned to the mud treatment system via a return path between the borehole and the drill string or inside the drill string, i.e., if the drill string is a dual-bore drill string. After the drilling fluid is cleaned in the mud treatment system, the clean drilling fluid may be returned to the mud tank.

In one embodiment of the invention, the automated drilling apparatus 100 includes sensors (or instruments) 132 for measuring drilling data. A variety of drilling data may be measured by the sensors 132. The locations of the sensors in the automated drilling apparatus 100 and the types of sensors 132 will be determined by the drilling data to be measured by the sensors 132. Examples of drilling data that may be measured by the sensors 132 include, but are not limited to, weight on bit, bit or drill string rotational speed, drill string rotational torque, rate of penetration, and drilling fluid flow rate. The drilling data may be measured at the surface and/or in the borehole. Further, measuring of drilling data may be direct or indirect. In the indirect measurement, the desired drilling data may be derived from other measurable drilling data. For example, drill string rotational torque may be measured at the surface using a sensor 132 on the top drive 118. Alternatively, pressure differential across the downhole motor 130 may be measured using a sensor 132 downhole. In another example, the load on hook 120 may be measured using any suitable means at the surface, and weight on bit may be inferred from the hook load. Various other drilling data not specifically mentioned above may be measured, or derived, as required by the drilling process.

In one embodiment, the drilling apparatus 100 includes one or more rig computing systems, such as rig computing system 134. In one embodiment, the rig computing system 134 includes various computing components and peripherals, such as a processor, memory, a display, a communications interface, and an input interface. The rig computing system 134 can receive measurement of drilling data from the various sensors 132 of the automated drilling apparatus 100. Information related to operation of the rig computing system 134 may be stored in some other computer-readable media 146 for subsequent loading into memory. Although the rig computing system 134 is shown primarily at the surface in FIG. 1, it should be noted that in other embodiments a portion or all of the rig computing system 134 may be located downhole.

Figure 2:
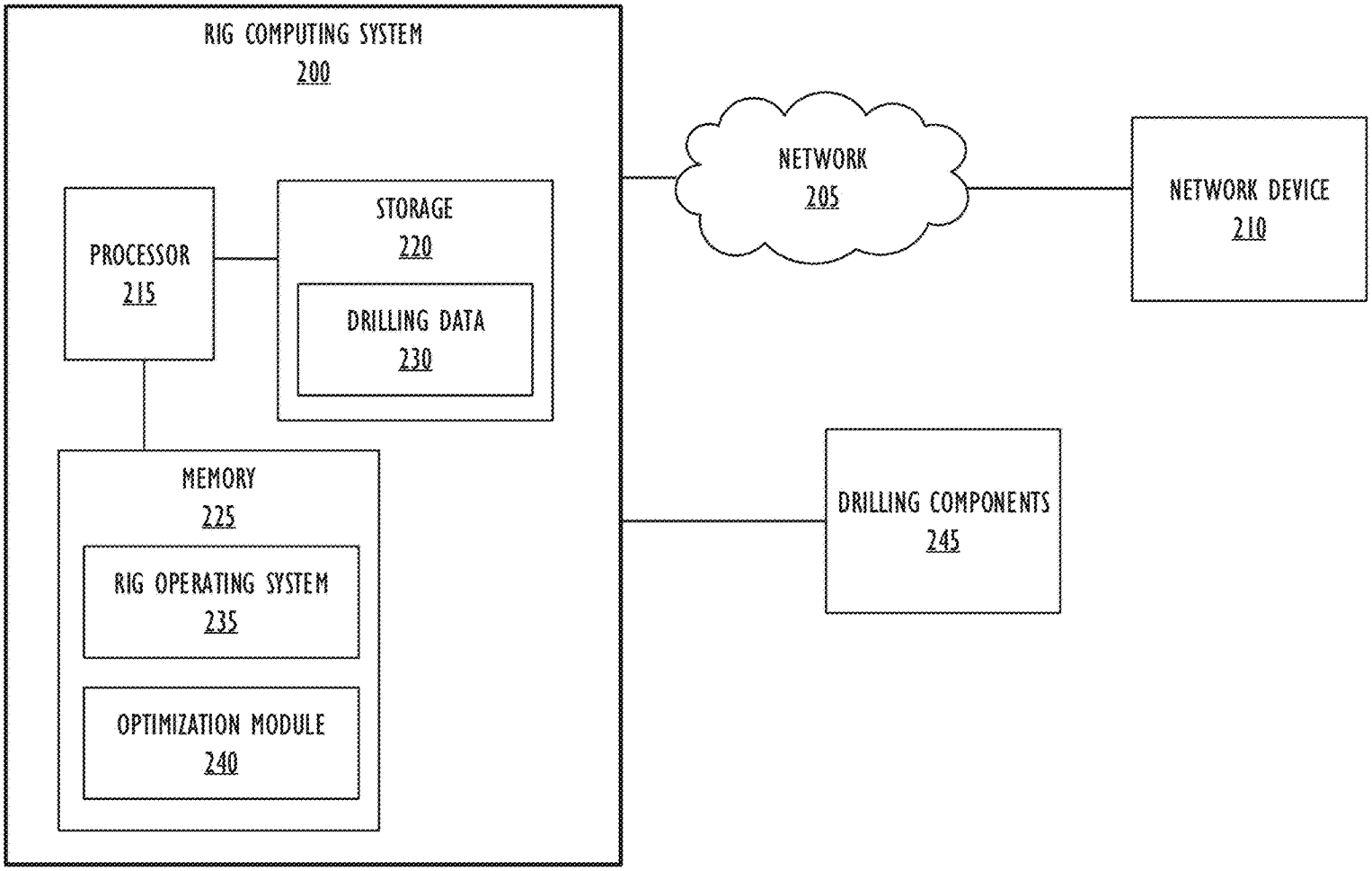
FIG. 2 is a system diagram illustrating a drilling rig software system for automated drilling, including an optimization module.

FIG. 2 depicts a system diagram illustrating a drilling rig software system for automated drilling. FIG. 2 includes a rig computing system 200 connected to one or more network devices 210 across a network 205. Rig computing system 200 may be, for example, a detailed version of rig computing system 134 of FIG. 1. Network device 210 may include any kind of device accessible across network 205, with which rig computing system 200 may communicate. For example, network device 210 may be an additional rig computing system, a server, a remote computer, or the like. Network 205 may include many different types of computer networks available today, such as the Internet, a corporate network, a Local Area Network (LAN), or a personal network, such as those over a Bluetooth connection. Each of these networks may contain wired or wireless programmable devices and operate using any number of network protocols (e.g., TCP/IP). Network 205 may be connected to gateways and routers, servers, and end user computers.

According to one or more embodiments, rig computing system 200 may include, for example, a storage 220, a memory 225 and processor 215. Processor 215 may include a single processor or multiple processors. Further, in one or more embodiment, processor 215 may include different kinds of processors, such as a central processing unit ("CPU") and a graphics processing unit ("GPU"). Memory 225 may include a number of software or firmware modules executable by processor 215. Memory 225 may include a single memory device or multiple memory devices. As depicted, memory 225 may include a rig operating system 235 and an optimization module 240. Rig operating system 235 may be a process automation platform that manages rig equipment to automatically perform drilling processes, sub-processes, sets of one or more drilling activities associated with each drilling process or sub-process, and sets of one or more drilling sub-activities associated with each drilling activity. For example, rig operating system 235 may be used to at least partially automate the drilling process of connecting a stand to the drill string by automatically performing the slips-to-bottom and bottom-to-slips drilling sub-processes, using a configuration of drilling parameters for each sub-process and each activity from a set of one or more drilling activities associated with each drilling sub-process. In the slips-to-bottom drilling sub-process, associated drilling activities may include taking weight, flow ramping, rotation ramping, and lowering the drill string. Rig operating system 235 may optimize automated performance of drilling processes, sub-processes, and activities by implementing optimization module 240's adjustments to the configurations of drilling parameters. In one or more embodiments, rig operating system 235 may receive instructions from optimization module 240 and coordinate the instructions with drilling components 245 to implement the well plan and improve automated performance of the drilling processes, sub-processes, activities, and sub-activities.

In one or more embodiments, optimization module 240 compares performance of drilling activities under the current configurations of drilling parameters to reference performance data, and where performance is poor compared to the reference performance data, determines one or more adjustments to the configurations of drilling parameters to optimize the automation. In some embodiments, optimization module 240 obtains a measure of performance for each drilling activity from drilling components 245. A measure of performance may be, e.g., a time or cost to perform, a value representing wear and tear on drilling components 245, a likelihood of risk or damage to drilling components 245 or drillers, and the like. In some embodiments, the measure of performance may combine one or more considerations into a single representative value. For example, the time to perform the drilling activity may be multiplied by a penalty representing additional wear and tear on drilling components 245 associated with higher speeds. In this way, the cost and time to replace or repair drilling components 245 when used at higher speeds is incorporated to give a more holistic measure of performance. If the faster performance times for each individual drilling activity require repair and replacement of drilling components 245 too frequently, the time gained and lowered drilling costs from quicker performances are consumed by the time and cost to repair and replace drilling components 245. Optimization module 240 may then calculate activity performance indexes for each drilling activity as described herein by obtaining a reference performance index comprising reference data for each of the one or drilling activities. A reference performance index is a baseline level of performance for the current activity performance to be measured against, and includes reference configurations of drilling parameters used to obtain the baseline level of performance for each activity. In some embodiments, the reference performance index may be stored in drilling data 230. In other embodiments, the reference performance may be retrieved from network device 210 through network 205.

Optimization module 240 may then compare the obtained measure of performance for each drilling activity to the reference data for the particular drilling activity and calculate an activity performance index for each drilling activity based at least in part on the comparison. Then, optimization module 240 may generate a drilling sub-process performance index based on the calculated activity performance indexes for the set of drilling activities associated with the drilling sub-process, resulting in a measure of performance for the drilling sub-process as a whole. When the drilling sub-process performance index indicates poor performance compared to the reference data, optimization module 240 may compare the configurations of drilling parameters for each drilling activity in the current well to the same parameters in the reference data, and recommend adjustments to the configurations of drilling parameters as needed. Rig operating system 235 may then relay the adjusted configurations of drilling parameters to drilling components 245 and operate drilling components 245 in compliance with the adjusted configurations of drilling parameters to improve automated performance of the drilling sub-process.

As discussed previously, in one or more embodiments, the reference performance index may be stored in drilling data 230, which in turn may be stored in storage 220 in the rig computing system. Storage 220 may include a single storage device, or multiple storage devices. Although the various components are depicted within a single computing device, in one or more embodiments, the various components and functionalities described with respect to rig computing system 200 may instead be reconfigured in a different combination, or may be distributed among multiple computing devices.

According to one or more embodiments, rig computing system 200 may communicate with one or more network devices 210 across network 205. In one or more embodiments, rig computing system 200 may transmit drilling data or other information from rig computing system 200 to network device 210. For example, rig computing system 200 may transmit data related to optimization module 240 to a network device 210 associated with an entity that manages the particular optimization module 240. Further, the network device 210 may include end user computers, servers, and the like, utilized in conjunction with rig computing system 200.

In one or more embodiments, multiple drilling applications may be utilized during drilling. The drilling applications may be managed by different entities, such as unique operators, contractors, owners, and the like. Thus, a first activity for a sub-process may be directed by a first application and managed by a first entity, whereas a second activity for the sub-process may be directed by a second application managed by a second entity. According to one or more embodiments, the rig computing system may toggle between the various drilling applications when appropriate. Further, in one or more embodiments, drilling data generated while a particular entity is controlling an activity may be partitioned into a separate storage from drilling data generated while another entity is controlling an activity. The separate storage may be, for example, a separate physical storage device, a storage partition in a physical storage device, or a different data structure on a storage device. Thus, ownership of an activity may be managed for example, based on depth, formation, or section of a well plan.

Figure 3:
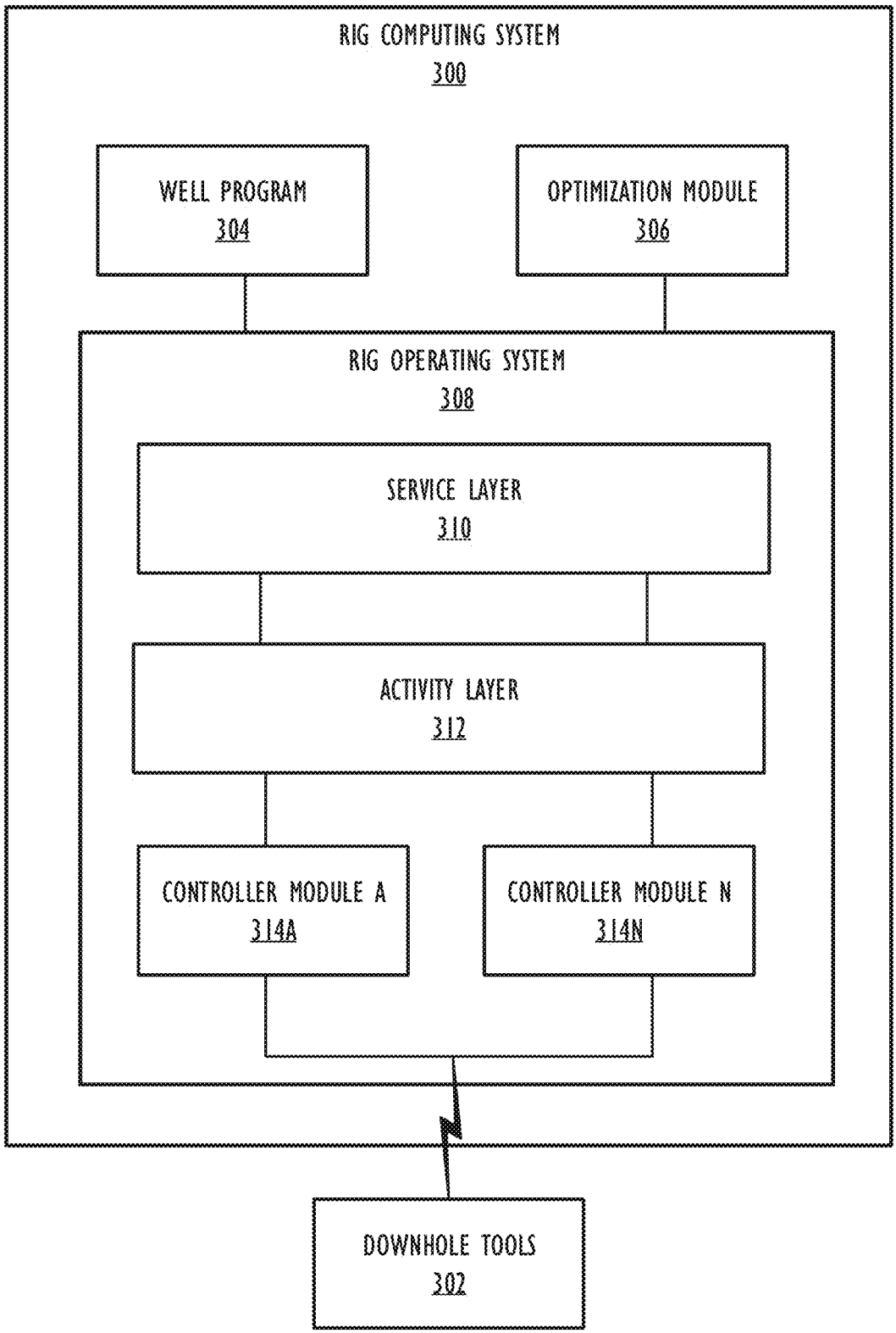
FIG. 3 is a block diagram illustrating components of a rig computing system.

Turning to FIG. 3, a block diagram illustrating components of a rig computing system is shown. Specifically, FIG. 3 provides a schematic of an example data flow within a rig computing system 300. Rig computing system 300 may include an optimization module 306 and a rig operating system 308. In addition, rig computing system 300 may include a well program 304, which may facilitate management of the rig. Rig operating system 308 may include several layers through which data flows. Rig operating system 308 may receive instructions from optimization module 306. Optimization module 306 may provide tool-agnostic instructions and adjustments to configurations of drilling parameters. That is, optimization module 306 may be written for generic drilling components, and rig operating system 308 may translate the tool-agnostic instructions into tool-specific instructions, to direct the specific downhole tools 302 controlled by rig computing system 300.

Rig operating system 308 may include multiple components or layers that are utilized to translate tool-agnostic well plans and adjustments to configurations of drilling parameters into tool-specific instructions to direct downhole tools 302 to implement the well plan. In one or more embodiments, rig operating system 308 may include a service layer 310, an activity layer 312, and a set of one or more controller modules 314. In one or more embodiments, service layer 310 may forward a tool-agnostic request to activity layer 312. Service layer 310 may identify one or more activities required to complete a requested service or sub-process. As an example, service layer 310 may receive instructions from a drilling application to perform a slips-to-bottom sub-process. Service layer 310 may manage the activities needed to perform the different sub-process functions required to achieve the objective from a current drilling state. In one or more embodiments, service layer 310 may switch between processes or objectives manually based on user input, or dynamically based on a predefined well plan or other instructions provided by optimization module 306 or well program 304. Further, in one or more embodiments, the process may be dynamically switched based on a model or algorithm input. For example, service layer 310 may switch the process objective from drilling to tripping or to reaming based on the input.

Service layer 310 may coordinate with activity layer 312 to manage the various activities required to complete the requested sub-process or service. Activity layer 312 may coordinate with one or more controller modules 314 to implement a particular activity using a configuration of drilling parameters. As an example, activity layer 312 may identify various controller modules required to implement an activity as directed by service layer 310. Further, according to one or more embodiments, activity layer 312 may determine whether one or more controller modules 314 are available for performing a necessary activity. In one or more embodiments, if a controller module 314 is not available, then activity layer 312 may trigger a notification such that the particular activity may be driven by a user.

According to one or more embodiments, controller modules 314 act as an abstraction layer that allows optimization module 306 to be tool-agnostic, and controller modules 314 to translate the instructions for specific downhole tools 302 or other drilling components. In one or more embodiments, controller modules 314 may include state machine logic to start and stop downhole tools 302 and other components, and bridge the process to the machine. Controller modules 314 may translate tool-agnostic instructions or adjustments to configurations of drilling parameters into tool-specific instructions and configurations of drilling parameters based on specific downhole tools 302 or other components available on a rig, thereby driving the tools. In one or more embodiments, controller modules 314 may be tool-specific. That is, a controller module may be associated with a particular tool or tools such that the controller module generates tool-specific instructions for that particular tool. Further, in one or more embodiments, controller modules 314 may be associated with multiple tools or components, or may be associated with a particular function of a particular tool. As an example, the top drive 118 may be utilized for sub-processes or activities such as circulation, rotation, and pipe handling. Each of circulation, rotation, and pipe handling may be managed by a separate controller module 314. The controller module 314 associated with a particular tool may drive that tool to implement actions to perform the activity. Further, according to one or more embodiments, controller modules 314 may be associated with particular functionality. For example, one or more controller modules 314 may be associated with rotation, whereas another one or more controller modules 314 may be associated with circulation. In this example, each controller module 314 may be associated with a particular set of drilling components based on functionality, and may include the capability to translate tool-agnostic instructions and adjustments to configurations of drilling parameters into tool-specific instructions and configurations of drilling parameters for tools associated with the particular functionality.

According to one or more embodiments, service layer 310 may manage the scheduling of the various sub-processes by activity layer 312 and controller modules 314. For example, service layer 310 may determine a current drilling state and, based on the drilling state, trigger activity layer 312, and thus controller modules 314, to perform an action. For example, if the objective is to perform the slips-to-bottom drilling sub-process, control modules 314 may prepare the hoisting system to take weight and lower the drill string, initiate pumps and top drive for flow and rotation ramping respectively, and the like.

In addition, service layer 310 may manage optimization module 306 from which instructions are received. In some embodiments, service layer 310 toggles between reference performance indexes used in optimization module 306 based on a drilling state. A drilling state may be determined based on sensor data from sensors 132. The drilling state may include contextual data from or determined by the sensors 132, or environmental contextual data, such as drilling depth. For example, a first reference performance index may be used in optimization module 306 until the drilling operation reaches a particular depth, at which point a second reference performance index may be used in optimization module 306 instead. As another example, a first reference performance index may be used in optimization module 306 for a vertical portion of the drilling operation and a second reference performance index may be used in optimization module 306 for a lateral section of the drilling operation. Thus, service layer 310 may monitor a current depth or other drilling state information, and toggle between the various reference performance indexes in use in optimization module 306 accordingly.

Further, in one or more embodiments, well program 304 may monitor various drilling measurements to ensure that the various drilling components perform within certain thresholds. As an example, thresholds may determine safe operation of the components, or may be utilized for resource management, such as power savings, or to limit wear and tear on machinery. According to one or more embodiments, the thresholds may be set by well program 304 or optimization module 306. The thresholds may be set based on various drilling parameters, such as drilling state (i.e., a current activity, a current depth, or other contextual information). In one or more embodiments, when a threshold is exceeded, well program 304 may modify the sub-process or activity directed by optimization module 306 such that the drilling parameter remains within a threshold.

Figure 4:
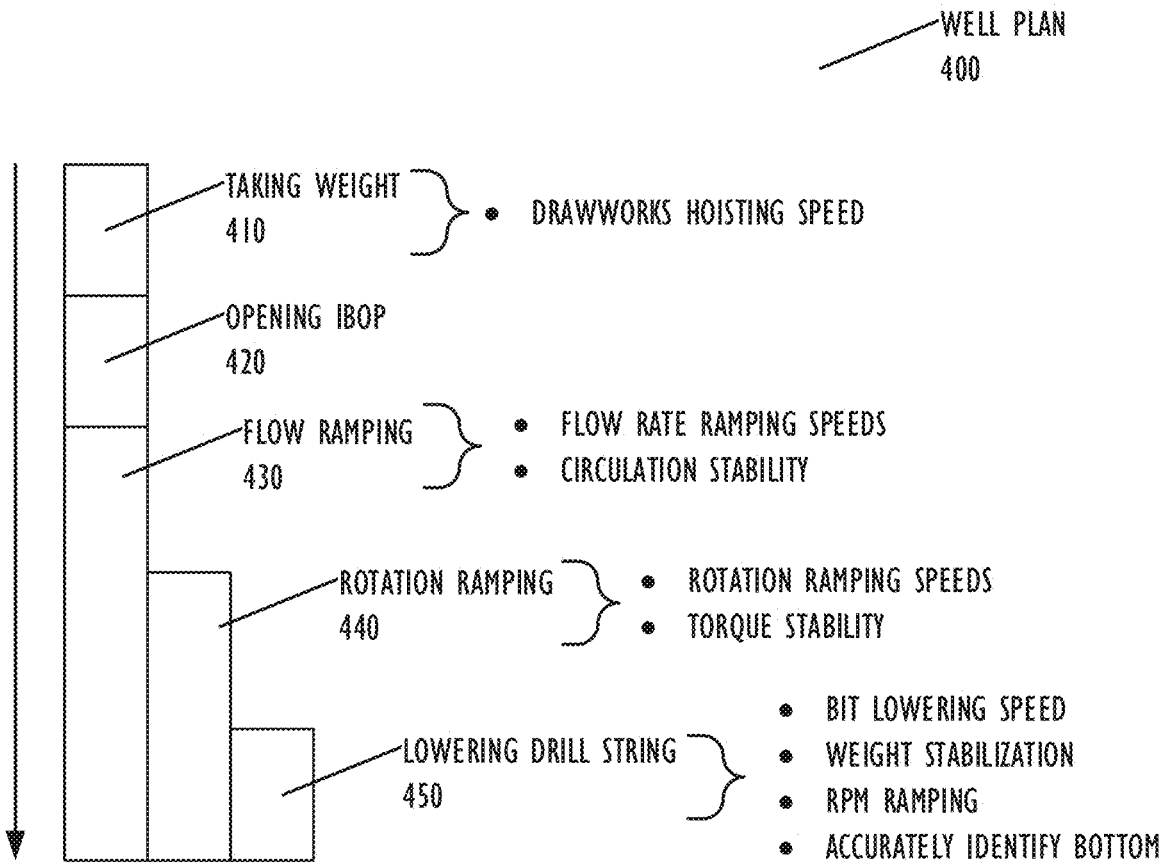
FIG. 4 is a flow diagram illustrating various operations of automated drilling and their associated activities.

FIG. 4 is a flow diagram illustrating various operations of automated drilling and their associated activities and configurations of drilling parameters. Specifically, FIG. 4 illustrates an example well plan 400 for the slips-to-bottom sub-process. Well plan 400 is an example well plan which may be used in conjunction with disclosed embodiments to optimize performance of an automated control system for drilling. Well plan 400 includes multiple phases, each of which may be considered an activity included in the slips-to-bottom sub-process. Remember that each activity may be associated with a configuration of drilling parameters. Well plan 400 begins at 410 with the taking weight activity, which uses a configuration of drilling parameters such as the drawworks hoisting speed. Each activity may be associated with a set of one or more sub-activities related to the drilling parameters. For example, the taking weight activity may comprise a sub-activity for managing the drawworks hoisting speed from rest to the speed indicated in the configuration of drilling parameters. Then, at 420, the next activity is opening an inside blow out preventer ("IBOP"). The flow diagram continues at 430 with the flow ramping activity. The flow ramping activity may use a configuration of drilling parameters such as flow rate ramping speeds and circulation stability, and may be associated with one or more sub-activities for managing flow rate ramping speeds and circulation stability. Thus, a controller module associated with flow and a controller module associated with circulation may be utilized by the rig operating system to implement the configuration of drilling parameters and accomplish the flow ramping activity 430. In some embodiments, well plan 400 may not be written toward particular mud pump specifications, such as liner size, pump efficiency, or strokes to achieve the flow rate. In those embodiments, the rig operating system may manage the mud pump's strokes per minute output to achieve the desired flow, without requiring instructions from the well plan that specify how to operate the mud pumps. The flow diagram continues at 440 with the rotation ramping activity. Here, the configuration of drilling parameters may include rotation ramping speed and torque stability, and associated sub-activities may include managing rotation ramping speed and torque stability. Thus, flow may be maintained throughout the rotation ramping activity. For example, rotation may not occur without active flow. At 450, the flow diagram continues with the lowering the drill string activity. The configuration of drilling parameters associated with lowering the drill string may include bit lowering speed, weight stabilization, and RPM ramping. The sub-activities associated with lowering the drill string may include managing weight stabilization, RPM ramping, and bit lowering speed from rest to the speed indicated in the configuration of drilling parameters, and accurately identifying the bottom.

Figure 5:
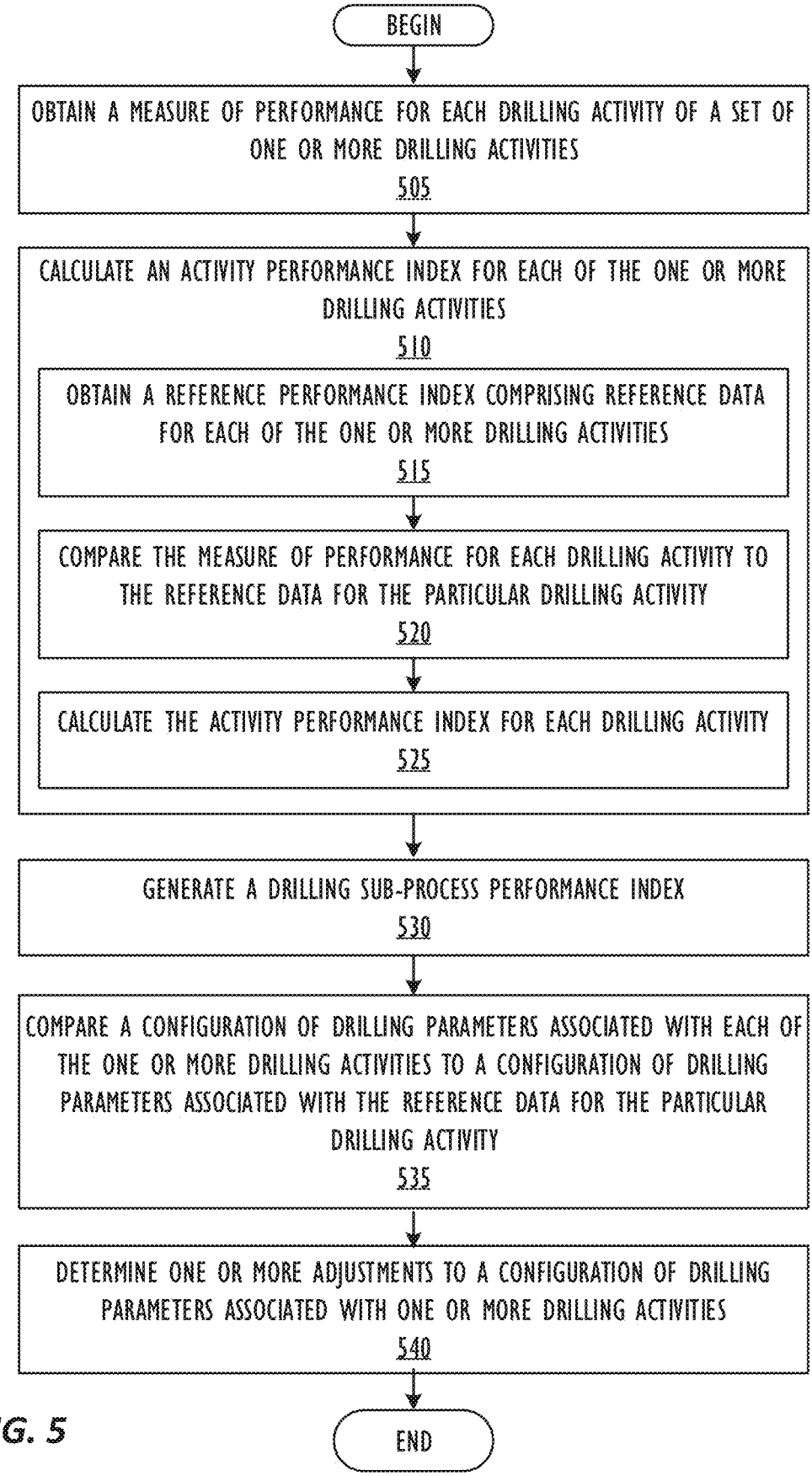
FIG. 5 is a flowchart illustrating an example method for optimizing performance of an automated drilling system, according to one or more embodiments.

FIG. 5 is a flowchart illustrating an example method for optimizing performance of a drilling sub-process by an automated drilling system, according to one or more embodiments. For purposes of explanation, the following steps will be described in the context of FIG. 2 and FIG. 4. However, it should be understood that the various actions may be taken by alternate components. In addition, the various actions may be performed in a different order. Further, some actions may be performed simultaneously, and some may not be required, or others may be added, according to various embodiments. Although FIG. 5 describes an example method for optimizing performance of a drilling sub-process using drilling activity performance indexes, the method described herein may be used to optimize performance of a drilling process using drilling sub-process performance indexes, and performance of a drilling activity using drilling sub-activity performance indexes, as may be understood in light of the following description.

The flow chart begins at 505, where optimization module 240 obtains a measure of performance for each drilling activity of a set of one or more drilling activities. In some embodiments, the drilling sub-process may comprise the set of one or more drilling activities. For example, a drilling sub-process may be performing slips-to-bottom, and comprise the set of drilling activities including taking weight, flow ramping, rotation ramping, and lowering the drill string. The activity lowering the drill string may comprise the sub-activities lowering the bit, stabilizing the weight against the bit, ramping the rotation speed, and accurately identifying bottom. In some embodiments, optimization module 240 obtains the measure of performance for each drilling activity from drilling components 245. In other embodiments, optimization module 240 obtains data from rig operating system 235 and determines the measure of performance based at least in part on the obtained data. As discussed previously, the measure of performance may be, e.g., a time to perform the activity, a value representing wear and tear on drilling components 245, a likelihood of risk or damage to drilling components 245 or drillers, and the like. In some embodiments, the measure of performance may combine one or more considerations into a single representative value. Returning to the slips-to-bottom drilling sub-process example, optimization module 240 may obtain a time to complete each of taking weight, flow ramping, rotation ramping, and lowering the drill string. Note that optimization module 240 need not consider every drilling activity included in the drilling sub-process. For example, the slips-to-bottom drilling sub-process includes opening the IBOP. However, optimization module 240 need not consider the activity of opening the IBOP in order to optimize the slips-to-bottom drilling sub-process, since performance of this activity varies little from one performance of the slips-to-bottom drilling sub-process to another.

Next, optimization module 240 calculates an activity performance index for each of the one or more drilling activities at 510. Step 510 further comprises steps 515, 520, and 525. At 515, optimization module 240 obtains a reference performance index comprising reference data for each of the one or more drilling activities. A reference performance index is a baseline level of performance for the current activity performance to be measured against, and includes reference configurations of drilling parameters used to obtain the baseline level of performance for each activity. In some embodiments, the reference performance index may be stored in drilling data 230. In other embodiments, the reference performance may be retrieved from network device 210 through network 205. At 520, optimization module 240 compares the measure of performance for each drilling activity obtained in step 505 to the reference data for the particular drilling activity obtained in step 515. In some embodiments, the comparison in 520 indicates that the measure of performance for the particular drilling activity is increased from the reference data for the particular drilling activity. This in turn may mean that the configuration of drilling parameters for the particular drilling activity allowed the automated control system for drilling to perform the particular drilling activity better than it would have using the reference configuration of drilling parameters for the particular drilling activity. In other embodiments, the comparison in 520 indicates that the measure of performance for the particular drilling activity is not increased from the reference data for the particular drilling activity. This may indicate that the automated control system for drilling performed the particular drilling activity worse using the configuration of drilling parameters for the particular drilling activity than it would have using the reference configuration of drilling parameters for the particular activity. Then, in step 525, optimization module 240 calculates the activity performance index for each drilling activity based at least in part on the comparison in step 520. For example, where the comparison in step 520 indicates that the measure of performance for the particular drilling activity is increased from the reference data for the particular drilling activity, the activity performance index for the particular drilling activity may be set to one. Where the comparison in 520 indicates that the measure of performance for the particular drilling activity is not increased from the reference data for the particular drilling activity, the activity performance index for the particular drilling activity may be set to zero. In the slips-to-bottom sub-process example, optimization module 240 obtains a reference performance index including reference times to complete each of taking weight, flow ramping, rotation ramping, and lowering the drill string. Optimization module 240 then compares the obtained times to the references times for each of taking weight, flow ramping, rotation ramping, and lowering the drill string. In this example, optimization module 240 may set the activity performance index to zero where the obtained time to complete an activity is greater than the reference time and to one where the obtained time to complete an activity is equal to or less than the reference time. Thus, the activity performance index for taking weight may be one, the activity performance index for flow ramping may be zero, the activity performance index for rotation ramping may be one, and the activity performance index for lowering the drill string may be zero.

At 530, optimization module 240 generates a drilling sub-process performance index based at least in part on the one or more activity performance indexes. In some embodiments, optimization module 240 may combine the one or more activity performance indexes to generate the drilling sub-process performance index. The one or more activity performance indexes may be combined by summing the one or more activity performance indexes together. In some embodiments, some of the one or more activity performance indexes may be weighted by an activity penalty based on the particular drilling activity. For example, the reference data for a particular drilling activity may be selected to represent the highest acceptable risk to the safety of a driller. If the activity performance index for the particular drilling activity indicates better performance than the reference data, the risk to the safety of the driller is unacceptably high and the activity performance index for the particular drilling activity will be weighted by a penalty. Returning to the slips-to-bottom drilling sub-process example, optimization module 240 may combine the activity performance indexes for taking weight, flow ramping, rotation ramping, and lowering the drill string to generate a slips-to-bottom drilling sub-process performance index of two. The flow chart continues at 535, where optimization module 240 compares a configuration of drilling parameters associated with each of the one or more drilling activities to the configuration of drilling parameters associated with the reference data for the particular drilling activity. The flow chart continues at 540, where optimization module 240 determines one or more adjustments to a current configuration of drilling parameters for one or more drilling activities based at least in part on the comparison in step 535. For example, where the activity performance index for a particular drilling activity indicates worse performance than the reference data, optimization module 240 may adjust the current configuration of one or more drilling parameters for the particular activity to align with the configuration of drilling parameters associated with the reference data for the particular drilling activity. The comparison of configurations of drilling parameters and the determination of one or more adjustments to the current configuration of drilling parameters may be performed by any appropriate method, e.g., using machine learning. In the slips-to-bottom drilling sub-process example, the activity performance indexes for flow ramping and lowering the drill string are zero, indicating these activities performed poorly compared to the reference data. Thus, optimization module 240 may compare the current configuration of drilling parameters for flow ramping to the configuration of drilling parameters included with the reference data for flow ramping and determine one or more adjustments to the current configuration of drilling parameters based at least in part on the comparison. The same may be done for the current configuration of drilling parameters for lowering the drill string. Lastly, optimization module 240 sends these adjustments to the current configurations of drilling parameters to rig operating system 235 to present to a driller for approval of the adjustments or to implement directly, which in turn improves automated performance of the drilling sub-process by rig operating system 235.

Figure 6A:
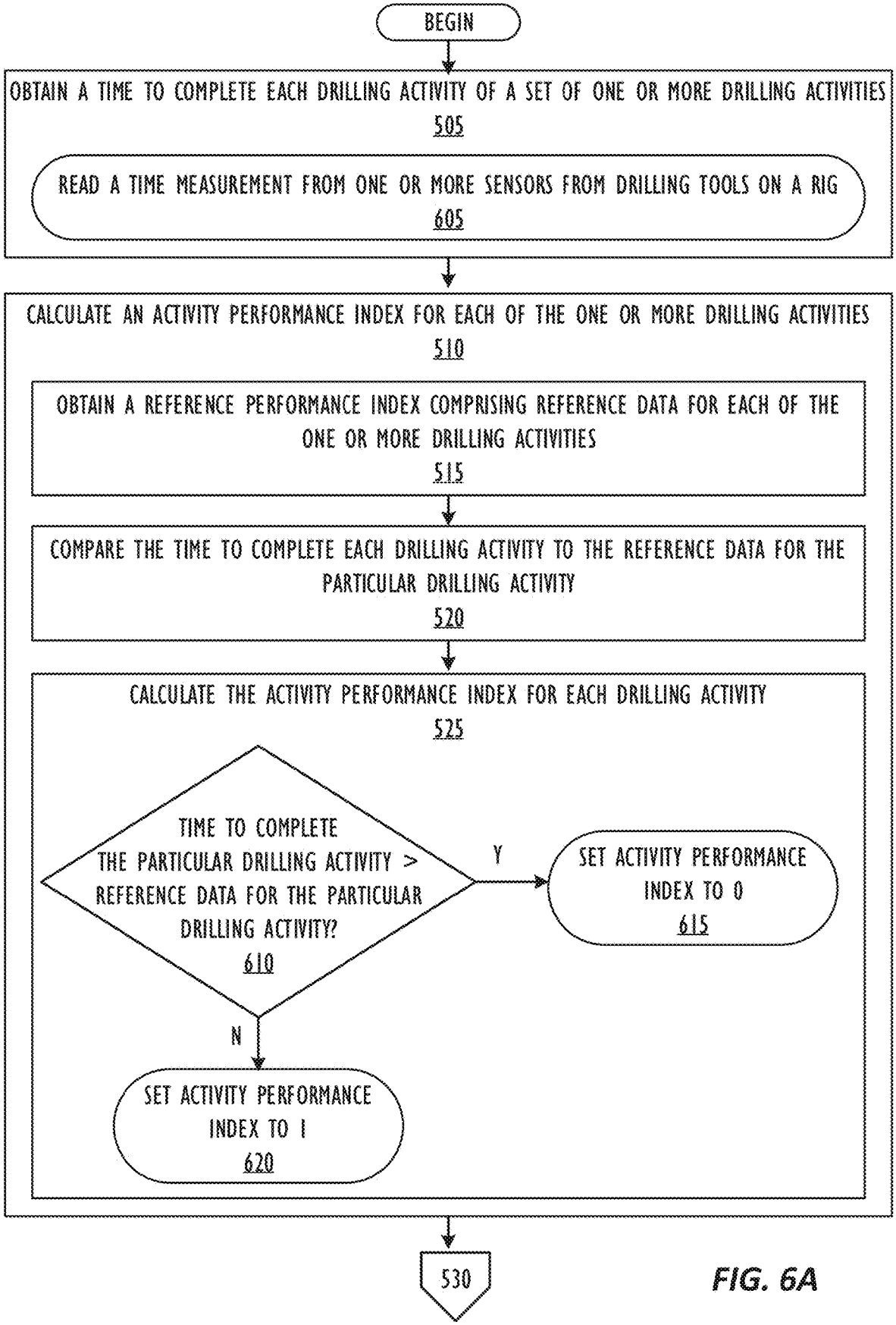
FIGS. 6A-B show a flowchart illustrating another example method for optimizing performance of an automated drilling system, according to one or more embodiments.
Figure 6B:
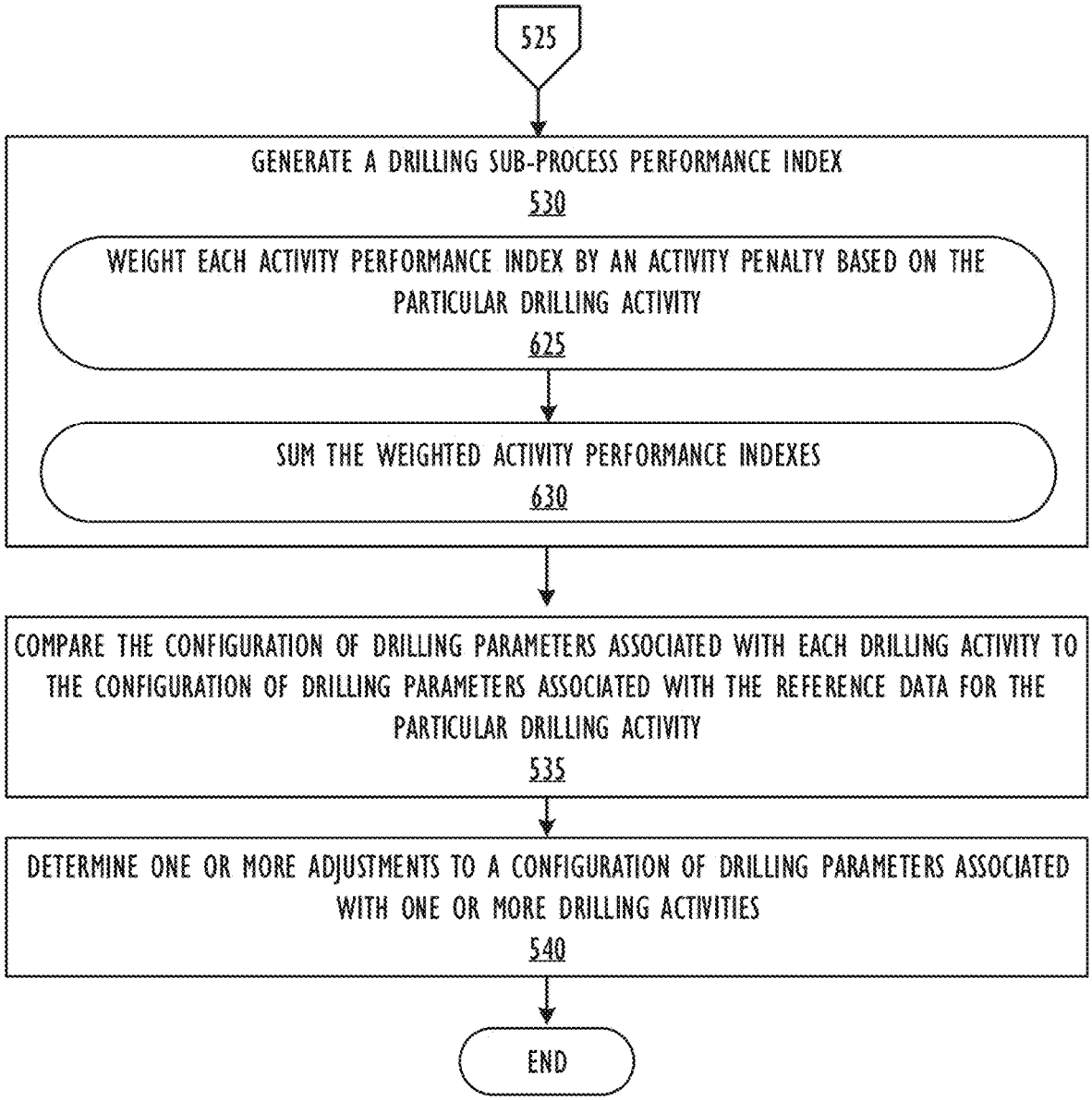

FIGS. 6A-B show a flowchart illustrating an example implementation of the example method for optimizing performance of a drilling sub-process by an automated drilling system described herein in reference to FIG. 5, according to one or more embodiments. In one or more embodiments, certain actions take place as part of obtaining a measure of performance to complete each drilling activity, calculating the activity performance index for each drilling activity, and generating a drilling sub-process performance index. However, the various actions may take place in other locations within the flow chart of FIGS. 6A-B. For purposes of explanation, the following steps will be described in the context of FIG. 2 and FIG. 4. However, it should be understood that the various actions may be taken by alternate components. In addition, the following steps will be described in the context of FIG. 5. However, it should be understood that the various actions may be performed in a different order. Further, some actions may be performed simultaneously, and some may not be required, or others may be added. Although FIGS. 6A-B describe an example method for optimizing performance of a drilling sub-process using drilling activity performance indexes, the method described herein may be used to optimize performance of a drilling process using drilling sub-process performance indexes, and performance of a drilling activity using drilling sub-activity performance indexes, as may be understood in light of the following description.

The flow chart begins at 505 of FIG. 6A and optimization module 240 obtains a time to complete each drilling activity of a set of one or more drilling activities. In some embodiments, the drilling sub-process may comprise the set of one or more drilling activities. For example, a drilling sub-process may be performing slips-to-bottom, where the set of one or more drilling activities includes taking weight, flow ramping, rotation ramping, and lowering the drill string. The activity lowering the drill string may comprise the sub-activities lowering the bit, stabilizing the weight against the bit, ramping the rotation speed, and accurately identifying bottom. In this example method, the measure of performance considered is the time to complete each drilling activity. However, any appropriate measure of performance may be considered instead, as described herein with reference to FIG. 5. In some embodiments, obtaining the time to complete each drilling activity may further comprise step 605. At 605, optimization module 240 reads a time measurement from one or more sensors from drilling tools on a rig. For example, optimization module 240 may read a time measurement from sensors included in drilling components 245. Returning to the slips-to-bottom drilling sub-process example, optimization module 240 may read a time measurement from sensors included in drilling components 245 for each of taking weight, flow ramping, rotation ramping, and lowering the drill string.

The flow chart continues at 510, where optimization module 240 calculates an activity performance index for each of the one or more drilling activities. Calculating an activity performance index further comprises steps 515, 520, and 525. At 515, optimization module 240 obtains a reference performance index comprising a reference time to complete and a reference configuration of drilling parameters for each of the one or more drilling activities. In some embodiments, the reference performance index is stored in drilling data 230. At 520, optimization module 240 compares the time to complete each drilling activity obtained in step 505 to the reference time to complete the particular drilling activity obtained in step 515. Then, in step 525, optimization module 240 calculates the activity performance index for each drilling activity based at least in part on the comparison in step 520. Calculating the activity performance index for each drilling activity 525 may optionally further comprise steps 610 and 615 or 620. At 610, optimization module 240 determines whether the time to complete the particular drilling activity is greater than the reference data for the particular drilling activity. If the time to complete the particular drilling activity is greater than the reference data for the particular drilling activity, optimization module 240 sets the activity performance index to zero at 615. If the time to complete the particular drilling activity is equal to or less than the reference data for the particular drilling activity, optimization module 240 sets the activity performance index to one at 620. In the slips-to-bottom sub-process example, optimization module 240 obtains a reference performance index including a reference time to complete and a configuration of drilling parameters for each of taking weight, flow ramping, rotation ramping, and lowering the drill string. Optimization module 240 then compares the obtained times to the references times for each of taking weight, flow ramping, rotation ramping, and lowering the drill string. Thus, the activity performance index for taking weight may be one, the activity performance index for flow ramping may be zero, the activity performance index for rotation ramping may be one, and the activity performance index for lowering the drill string may be zero.

The flow chart continues at 530 of FIG. 6B and optimization module 240 generates a drilling sub-process performance index based at least in part on the one or more activity indexes calculated in 525. In some embodiments, optimization module 240 may combine the one or more activity performance indexes to generate the drilling sub-process performance index. Returning to the slips-to-bottom drilling sub-process example, optimization module 240 may sum the activity performance indexes for taking weight, flow ramping, rotation ramping, and lowering the drill string to generate a slips-to-bottom drilling sub-process performance index of two. Generating the drilling sub-process performance index 530 may optionally further comprise steps 625 and 630. At 625, optimization module 240 weights each activity performance index by an activity penalty based on the particular drilling activity. For example, optimization module 240 may weight rotation ramping with a particular penalty corresponding to cost, wear and tear on the tools, risk, and the like associated with rotation ramping. At 630, optimization module 240 sums or otherwise combines the activity performance indexes, whether weighted at step 630 or not. In the slips-to-bottom drilling sub-process example, optimization module 240 may weight the rotation ramping performance index by a penalty of 0.75, which then results in a slips-to-bottom drilling sub-process performance index of 1.75.

Next, at 535, optimization module 240 compares the current configuration of drilling parameters associated with each of the one or more drilling activities to the configuration of drilling parameters associated with the reference data for the particular drilling activity. Then, at 540, optimization module 240 determines one or more adjustments to the current configuration of drilling parameters associated with each of the one or more drilling activities based at least in part on the comparison from 535. The comparison of configurations of drilling parameters and the determination of one or more adjustments to the current configuration of drilling parameters may be performed by any appropriate method, e.g., using machine learning. In the slips-to-bottom drilling sub-process example, the activity performance indexes for flow ramping and lowering the drill string are zero, indicating these activities performed poorly compared to the reference data. Thus, optimization module 240 may compare the current configuration of drilling parameters for flow ramping to the configuration of drilling parameters included with the reference data for flow ramping, and determine one or more adjustments to the current configuration of drilling parameters based at least in part on the comparison. The same may be done for the current configuration of drilling parameters for lowering the drill string. Lastly, optimization module 240 sends these adjustments to the current configurations of drilling parameters to rig operating system 235 to present to a driller for approval of the adjustments or to implement directly, which in turn improves automated performance of the drilling sub-process by rig operating system 235.

While the prior examples describe implementing the example method for performance optimization to improve performance of the slips-to-bottom sub-process, the example method for performance optimization may be used to improve performance of any drilling process, sub-process, or activity. As another example, the method for performance optimization may be used to improve performance of the bottom-to-slips sub-process by an automated control system for drilling. The set of one or more drilling activities for performing the bottom-to-slips sub-process includes raising the drill string, rotation stopping, flow stopping, closing the IBOP, and setting in slips. The activity raising the drill string may comprise the sub-activities of raising the bit and changing rotation speed and flow speed. The configuration of drilling parameters associated with raising the drill string includes a drill off weight and rotation and an off bottom rotation and flow rate. Rotation stopping may comprise the sub-activity of slowing the rotation speed from the current speed to rest and may be associated with a configuration of drilling parameters, including a rotation slowing speed. Flow stopping may comprise the sub-activity of slowing the flow rate from the current rate to rest and may be associated with a configuration of drilling parameters, including a flow slowing speed. The bottom-to-slips sub-process includes closing the IBOP but as described previously, optimization module 240 need not consider this activity to optimize performance of the bottom-to-slips sub-process. Setting in slips may comprise setting a connection height and lowering the drill string into the slips, and may be associating with a configuration of drilling parameters, including a drawworks lowering speed and a connection height.

Returning to the flowchart of FIGS. 6A-6B, optimization module 240 obtains a time to complete each of raising the drill string, rotation stopping, flow stopping, and setting in slips. In this example, the measure of performance considered is the time to complete each drilling activity. However, any appropriate measure of performance may be considered instead, as described herein with reference to FIG. 5. In some embodiments, obtaining the time to complete each drilling activity may further comprise step 605. At 605, optimization module 240 reads a time measurement from one or more sensors from drilling tools on a rig. For example, optimization module 240 may read a time measurement from sensors included in drilling components 245 for each of raising the drill string, rotation stopping, flow stopping, and setting in slips. The flow chart continues at 510, where optimization module 240 calculates an activity performance index for each of raising the drill string, rotation stopping, flow stopping, and setting in slips. Calculating an activity performance index further comprises steps 515, 520, and 525. At 515, optimization module 240 obtains a reference performance index comprising a reference time to complete and a reference configuration of drilling parameters for each of raising the drill string, rotation stopping, flow stopping, and setting in slips. Optimization module 240 then compares the obtained times to the references times for each of raising the drill string, rotation stopping, flow stopping, and setting in slips. Thus, the activity performance index for raising the drill string may be one, the activity performance index for rotation stopping may be zero, the activity performance index for flow stopping may be one, and the activity performance index for setting in slips may be zero.

The flow chart continues at 530 of FIG. 6B and optimization module 240 generates a bottom-to-slips drilling sub-process performance index based at least in part on the activity indexes calculated in 525. In some embodiments, optimization module 240 combines the activity performance indexes to generate the bottom-to-slips drilling sub-process performance index. For example, optimization module 240 sums the activity performance indexes for raising the drill string, rotation stopping, flow stopping, and setting in slips to generate a bottom-to-slips drilling sub-process performance index of two. Generating the drilling sub-process performance index 530 may optionally further comprise steps 625 and 630. At 625, optimization module 240 weights each activity performance index by an activity penalty based on the particular drilling activity. For example, optimization module 240 may weight flow stopping with a particular penalty corresponding to cost, wear and tear on the tools, risk, and the like associated with flow stopping. At 630, optimization module 240 sums or otherwise combines the activity performance indexes, whether weighted at step 630 or not. For example, optimization module 240 may weight the flow stopping performance index of one by a penalty of 0.75, resulting in a weighted activity performance index of 0.75 for flow stopping and a bottom-to-slips drilling sub-process performance index of 1.75, instead of two. Next, at 535, optimization module 240 compares the current configuration of drilling parameters associated with each of raising the drill string, rotation stopping, flow stopping, and setting in slips to the configuration of drilling parameters associated with the reference data for the particular drilling activity. Then, at 540, optimization module 240 determines one or more adjustments to the current configuration of drilling parameters associated with each of the drilling activities based at least in part on the comparison from 535. The comparison of configurations of drilling parameters and the determination of one or more adjustments to the current configuration of drilling parameters may be performed by any appropriate method, e.g., using machine learning. For example, the activity performance indexes for rotation stopping and setting in slips are zero, indicating these activities performed poorly compared to the reference data. Thus, optimization module 240 may compare the current configuration of drilling parameters for rotation stopping to the configuration of drilling parameters included with the reference data for rotation stopping, and determine one or more adjustments to the current configuration of drilling parameters based at least in part on the comparison. The same may be done for the current configuration of drilling parameters for setting in slips. Lastly, optimization module 240 sends these adjustments to the current configurations of drilling parameters to rig operating system 235 to present to a driller for approval of the adjustments or to implement directly, which in turn improves automated performance of the drilling sub-process by rig operating system 235.

Figure 7A:
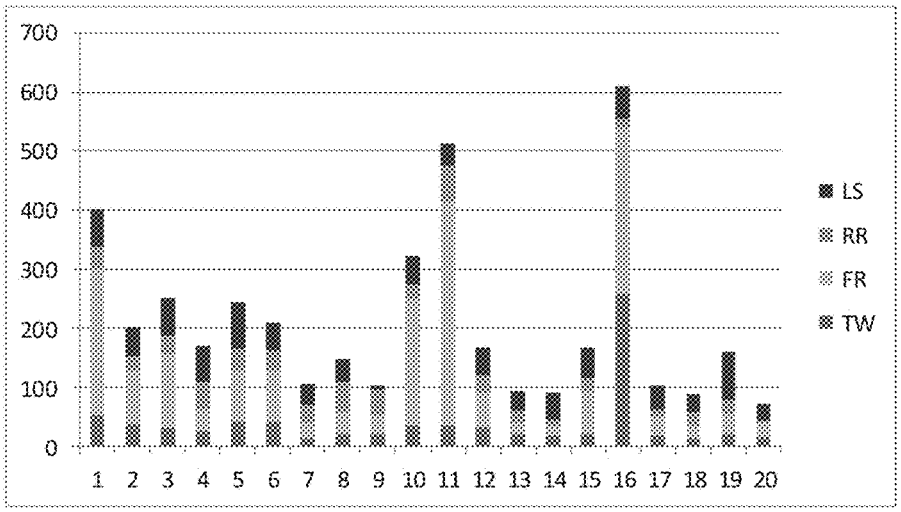

In alternative embodiments, a reference performance index may be generated by optimization module 240. FIGS. 7A-B illustrate generation of an example reference performance index using example reference data. To generate the reference performance index, optimization module 240 obtains reference data. The reference data comprises data about one or more instances of the sub-process of interest. The data for each instance of the sub-process includes a measure of performance and a configuration of drilling parameters used to obtain the measure of performance for each drilling activity in the drilling sub-process. The number of instances of the sub-process considered in the generation of the reference performance index may depend on the data available, the number of instances considered relevant to the current performance of the sub-process, and the like. For example, performance of the sub-process at a depth of 1000 feet may be irrelevant to performance of the sub-process at a depth of 3000 feet, and thus an instance of the sub-process at 1000 feet is excluded from the reference performance index for a depth of 3000 feet. The reference data may be sourced from the automated drilling system's historical performance in the current well or in a reference well. Alternatively, the reference data may come from an individual driller's performance in the current well or in a reference well. As an example for the slips-to-bottom sub-process, measure of performance data 710 shows a time in seconds to complete each of taking weight (TW), flow ramping (FR), rotation ramping (RR), and lowering the drill string (LS) for connection numbers 1-20. The individual activity times for completion are added together to generate the time to complete the slips-to-bottom (S2B) sub-process for each connection number.

In some embodiments, where the reference data includes data from multiple instances of the sub-process, optimization module 240 may compare or otherwise combine the multiple instances of the sub-process to determine an appropriate baseline measure of performance and configuration of drilling parameters for each drilling activity in the sub-process. Any appropriate method of comparison may be used, e.g., machine learning. In one embodiment, optimization module 240 bundles the measure of performance for each drilling activity in the drilling sub-process into a measure of performance for the drilling sub-process as a whole, as shown in measure of performance data 710 and the time to complete the slips-to-bottom sub-process. Optimization module 240 may then select appropriate instances of the sub-process to include in the reference performance index. In some embodiments, optimization module 240 selects a certain number of instances of the sub-process with the best measures of performance, e.g., the ten quickest instances. For example, optimization module 240 formats the measure of performance data 710 as histogram 720 to determine the ten quickest times to perform the slips-to-bottom sub-process. These ten quickest times to perform the slips-to-bottom sub-process indicate the best performances 730. Although this example uses a histogram to compare measure of performance data 710, other visualizations of data may be used, such as bar graphs, line graphs, and the like. Once optimization module 240 has selected the instances of the sub-process to include in the reference performance index, optimization module 240 may compare the measures of performance and configurations of drilling parameters from the instances to create a reference performance index. Recall that the reference performance index comprises a baseline measure of performance and a configuration of drilling parameters for each activity in the drilling sub-process. Returning to the previous example, the times to complete each activity from each connection number in best performances 730 may be averaged to generate reference performance index 740. This example averages the times to complete the activity, but any appropriate combination method may be used, e.g., machine learning. Although FIGS. 7A-7B illustrates generation of an example reference performance index using example reference data for a set of drilling activities comprising a drilling sub-process, the method described herein may use reference data for a set of drilling sub-processes comprising a drilling process, and reference data for a set of drilling sub-activities comprising a drilling activity.

FIG. 7C illustrates an example optimization of an automated control system for drilling using the example reference performance index generated in FIGS. 7A-7B. Measure of performance data for connection 21 750 includes a time in seconds to complete each of taking weight, flow ramping, rotation ramping, and lowering the drill string for connection 21. Optimization module 240 compares the measure of performance data for connection 21 750 to reference performance index 740 to obtain performance indexes for connection 21 755, which indicate the automated control system for drilling did not meet the maximum slips-to-bottom performance index of four. Optimization module 240 may then determine which drilling activities obtained an activity performance index of zero: taking weight, flow ramping, and lowering the drill string. Optimization module 240 then compares the current configuration of drilling parameters for those activities to the reference configurations of drilling parameters for those activities and determines one or more adjustments to the configurations of drilling parameters for those activities. The automated control system for drilling implements the one or more adjustments to the configurations of drilling parameters determined by optimization module 240 and performs the slips-to-bottom sub-process for connection 22. Optimization module 240 obtains measure of performance data for connection 22 760, which includes a time in seconds to complete each of taking weight, flow ramping, rotation ramping, and lowering the drill string for connection 22. Optimization module 240 then compares the measure of performance data for connection 22 760 to reference performance index 740 to obtain performance indexes for connection 22 765, which indicate the automated control system for drilling met the maximum slips-to-bottom performance index of four. As illustrated in this example, the optimization methods described herein may be performed for each instance of the drilling process, sub-process, or activity, such that adjustments to configurations of drilling parameters may be implemented in near real-time.

As described previously with reference to FIG. 3, one or more reference performance indexes may be used to optimize performance of the automated control system for drilling. For example, reference performance index 740 may be associated with a first drilling state, e.g., a vertical drilling section of the well, and used while the automated control system for drilling operates in the first drilling state. Another reference performance index 750 may be associated with a second drilling state, e.g., a lateral drilling section of the well, and used while the automated control system for drilling operates in the second drilling state. In some embodiments, optimization module 240 may determine a current drilling state and select an appropriate reference performance index based on the current drilling state. In other embodiments, the appropriate reference performance index is provided to optimization module 240. For example, service layer 310 may manage optimization module 240 and toggle between reference performance indexes based on the drilling state.

Figure 8:
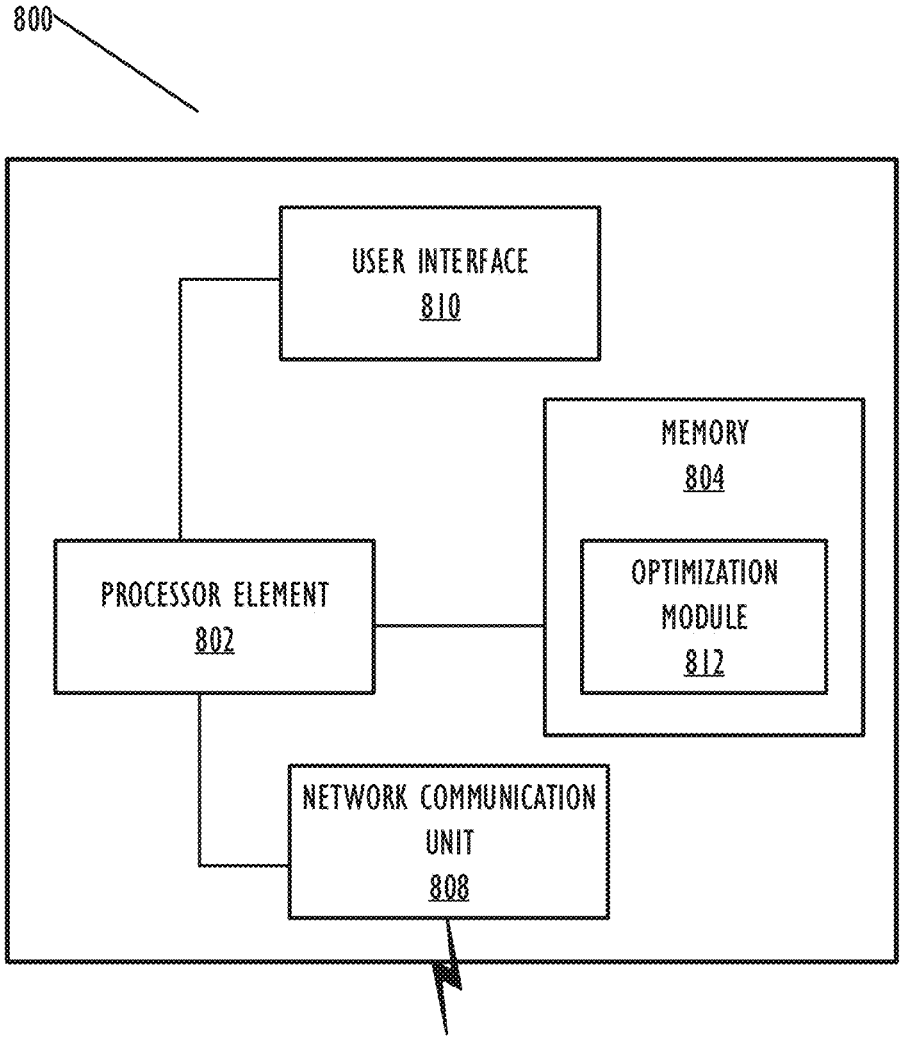
FIG. 8 is a block diagram illustrating a rig computing device for use with techniques described herein according to another embodiment.

FIG. 8 is a block diagram illustrating a rig computing device 800 for use with techniques described herein according to another embodiment. FIG. 8 illustrates that memory 804 may be operatively coupled to a processor element 802. Memory 804 may be a non-transitory medium configured to store various types of data. For example, memory 804 may include one or more memory devices that comprise a non-volatile storage device and/or volatile memory. Volatile memory, such as random access memory (RAM), can be any suitable non-permanent storage device. The non-volatile storage devices can include one or more disk drives, optical drives, solid-state drives (SSDs), tap drives, flash memory, read only memory (ROM), and/or any other type memory designed to maintain data for a duration time after a power loss or shut down operation. In certain instances, the non-volatile storage device may be used to store overflow data if allocated RAM is not large enough to hold all working data. The non-volatile storage device may also be used to store programs that are loaded into the RAM when such programs are selected for execution.

Persons of ordinary skill in the art are aware that software programs may be developed, encoded, and compiled in a variety computing languages for a variety software platforms and/or operating systems and subsequently loaded and executed by processor element 802. In one embodiment, the compiling process of the software program may transform program code written in a programming language to another computer language such that processor element 802 is able to execute the programming code. For example, the compiling process of the software program may generate an executable program that provides encoded instructions (e.g., machine code instructions) for processor element 802 to accomplish specific, non-generic, particular computing functions.

After the compiling process, the encoded instructions may then be loaded as computer executable instructions or process steps to processor element 802 from storage (e.g., memory 804) and/or embedded within processor element 802 (e.g., cache). Processor element 802 can execute the stored instructions or process steps in order to perform instructions or process steps to transform the computing device into a non-generic, particular, specially programmed machine or apparatus. Stored data, e.g., data stored by a storage device, can be accessed by processor element 802 during the execution of computer executable instructions or process steps to instruct one or more components within computing device 800.

A user interface 810 can include a display, positional input device (such as a mouse, touchpad, touchscreen, or the like), keyboard, or other forms of user input and output devices. User interface 810 can be coupled to processor element 802. Other output devices that permit a user to program or otherwise use the computing device can be provided in addition to or as an alternative to network communication unit 808. When the output device is or includes a display, the display can be implemented in various ways, including by a liquid crystal display (LCD) or a cathode-ray tube (CRT) or light emitting diode (LED) display, such as an OLED display. Persons of ordinary skill in the art are aware that computing device 800 may comprise other components well known in the art, such as sensors, powers sources, and/or analog-to-digital converters, not explicitly shown in FIG. 8.

The programmable devices depicted in FIG. 8 are a schematic illustration of embodiments of programmable devices which may be utilized to implement various embodiments discussed herein. Various components of the programmable devices depicted in FIG. 8 may be combined in a system-on-a-chip (SoC) architecture.

It is to be understood that the various components of the flow diagrams described above, could occur in a different order or even concurrently. It should also be understood that various embodiments of the inventions may include all or just some of the components described above. Thus, the flow diagrams are provided for better understanding of the embodiments, but the specific ordering of the components of the flow diagrams are not intended to be limiting unless otherwise described so.

Program instructions may be used to cause a general-purpose or special-purpose processing system that is programmed with the instructions to perform the operations described herein. Alternatively, the operations may be performed by specific hardware components that contain hard-wired logic for performing the operations, or by any combination of programmed computer components and custom hardware components. The methods described herein may be provided as a computer program product that may include a machine readable medium having stored thereon instructions that may be used to program a processing system or other electronic device to perform the methods. The term "machine readable medium" used herein shall include any medium that is capable of storing or encoding a sequence of instructions for execution by the machine and that cause the machine to perform any one of the methods described herein. The term "machine readable medium" shall accordingly include, but not be limited to, tangible, non-transitory memories such as solid-state memories, optical and magnetic disks. Furthermore, it is common in the art to speak of software, in one form or another (e.g., program, procedure, process, application, module, logic, and so on) as taking an action or causing a result. Such expressions are merely a shorthand way of stating that the execution of the software by a processing system causes the processor to perform an action or produce a result.

It is to be understood that the above description is intended to be illustrative, and not restrictive. For example, the above-described embodiments may be used in combination with each other. As another example, the above-described flow diagrams include a series of actions which may not be performed in the particular order depicted in the drawings. Rather, the various actions may occur in a different order, or even simultaneously. Many other embodiments will be apparent to those of skill in the art upon reviewing the above description. The scope of the invention should therefore be determined with reference to the appended claims, along with the full scope of equivalents to which such claims are entitled.

What is claimed is:

1. A method for optimizing performance of an automated control system for drilling, comprising:

obtaining a measure of performance for each drilling activity of a set of one or more drilling activities, wherein a drilling sub-process comprises the set of one or more drilling activities;

calculating an activity performance index for each of the one or more drilling activities, comprising:

obtaining a reference performance index comprising reference data for each of the one or more drilling activities;

comparing, for each of the one or more drilling activities, the measure of performance to the reference data;

calculating the activity performance index for each of the one or more drilling activities based at least in part on the comparing;

generating a drilling sub-process performance index based on the one or more activity performance indexes;

comparing, for each of the one or more drilling activities, a configuration of one or more drilling parameters to a reference configuration of one or more drilling parameters associated with the reference data for the particular drilling activity; and adjusting the configuration of one or more drilling parameters associated with the one or more drilling activities based at least in part on the comparing.

2. The method of claim 1, wherein calculating the activity performance index comprises:

in response to a determination that the measure of performance for a first drilling activity is increased from the reference data for the first drilling activity, setting the activity performance index for the first drilling activity to one; and in response to a determination that the measure of performance for a second drilling activity is not increased from the reference data for the second drilling activity, setting the activity performance index for the second drilling activity to zero.

3. The method of claim 1, wherein generating the drilling sub-process performance index comprises summing the activity performance indexes associated with the set of one or more drilling activities comprising the drilling sub-process.

4. The method of claim 3, wherein generating the drilling sub-process performance index further comprises weighting at least one activity performance index by an activity penalty based on the particular drilling activity.

5. The method of claim 1, wherein obtaining the measure of performance for each drilling activity comprises reading a measurement from a sensor from a drilling tool on a rig.

6. The method of claim 1, wherein the measure of performance for each drilling activity is a time to complete the particular drilling activity.

7. A computer readable medium for optimizing performance of an automated control system for drilling, comprising computer readable code executable by one or more processors to:

obtain a measure of performance for each drilling activity of a set of one or more drilling activities, wherein a drilling sub-process comprises the set of one or more drilling activities;

calculate an activity performance index for each of the one or more drilling activities, further comprising computer readable code to:

obtain a reference performance index comprising reference data for each of the one or more drilling activities;

compare, for each of the one or more drilling activities, the measure of performance to the reference data;

calculate the activity performance index for each of the one or more drilling activities based at least in part on the comparison;

generate a drilling sub-process performance index based on the one or more activity performance indexes;

compare, for each of the one or more drilling activities, a configuration of one or more drilling parameters to a reference configuration of one or more drilling parameters associated with the reference data for the particular drilling activity; and adjust the configuration of one or more drilling parameters associated with the one or more drilling activities based at least in part on the comparison.

8. The computer readable medium of claim 7, wherein the computer readable code to calculate the activity performance index comprises computer readable code to:

in response to a determination that the measure of performance for a first drilling activity is increased from the reference data for the first drilling activity, set the activity performance index for the first drilling activity to zero; and in response to a determination that the measure of performance for a second drilling activity is not increased from the reference data for the second drilling activity, set the activity performance index for the second drilling activity to one.

9. The computer readable medium of claim 7, wherein the computer readable code to generate the drilling sub-process performance index comprises computer readable code to sum the activity performance indexes associated with the set of one or more drilling activities comprising the drilling sub-process.

10. The computer readable medium of claim 7, wherein the computer readable code to generate the drilling sub-process performance index further comprises computer readable code to weight at least one activity performance index by an activity penalty based on the particular drilling activity.

11. The computer readable medium of claim 7, wherein the computer readable code to obtain the measure of performance for each drilling activity comprises computer readable code to read a measurement from a sensor from a drilling tool on a rig.

12. The computer readable medium of claim 7, wherein the measure of performance for each drilling activity is a time to complete the particular drilling activity.

13. A system for optimizing performance of an automated control system for drilling, comprising one or more processors;

one or more memory devices coupled to the one or more processors and comprising computer readable code executable by the one or more processors to:

obtain a measure of performance for each drilling activity of a set of one or more drilling activities, wherein a drilling sub-process comprises the set of one or more drilling activities;

calculate an activity performance index for each of the one or more drilling activities, further comprising computer readable code to:

obtain a reference performance index comprising reference data for each of the one or more drilling activities;

compare, for each of the one or more drilling activities, the measure of performance to the reference data;

calculate the activity performance index for each of the one or more drilling activities based at least in part on the comparison;

generate a drilling sub-process performance index based on the one or more activity performance indexes;

compare, for each of the one or more drilling activities, a configuration of one or more drilling parameters to a reference configuration of one or more drilling parameters associated with the reference data for the particular drilling activity; and adjust the configuration of one or more drilling parameters associated with the one or more drilling activities based at least in part on the comparison.

14. The system of claim 13, wherein the computer readable code to generate the drilling sub-process performance index comprises computer readable code to sum the activity performance indexes associated with the set of one or more drilling activities comprising the drilling sub-process.

15. The system of claim 14, wherein the computer readable code to generate the drilling sub-process performance index further comprises computer readable code to weight at least one activity performance index by an activity penalty based on the particular drilling activity.

16. The system of claim 13, wherein the computer readable code to obtain the measure of performance for each drilling activity comprises computer readable code to read a measurement from a sensor from a drilling tool on a rig.

17. The system of claim 13, wherein the measure of performance for each drilling activity is a time to complete the particular drilling activity.

18. A method for optimizing performance of a slips-to-bottom sub-process by an automated control system for drilling, comprising:

obtaining a time to complete each drilling activity of a set of one or more drilling activities for a slips-to-bottom sub-process;

calculating an activity performance index for each of the one or more drilling activities, comprising:

obtaining a reference performance index comprising reference data for each of the one or more drilling activities, comparing, for each of the one or more drilling activities, the time to complete to the reference data, calculating the activity performance index for each of the one or more drilling activities based at least in part on the comparing, and generating a slips-to-bottom sub-process performance index based on the one or more activity performance indexes;

comparing, for each of the one or more drilling activities, a configuration of one or more drilling parameters to a reference configuration of one or more drilling parameters associated with the reference data for the particular drilling activity; and adjusting the configuration of one or more drilling parameters associated with the one or more drilling activities based at least in part on the comparing.

19. The method of claim 18, wherein the set of one or more drilling activities for the slips-to-bottom sub-process comprises taking weight, flow ramping, rotation ramping, and lowering a drill string.

20. The method of claim 18, wherein the measure of performance for each drilling activity is a time to complete the particular drilling activity.

* * * * *